US009990844B2

(12) United States Patent
Park et al.

(10) Patent No.: US 9,990,844 B2
(45) Date of Patent: Jun. 5, 2018

(54) METHOD FOR HANDLING MISBEHAVING VEHICLE AND V2X COMMUNICATON SYSTEM PERFORMING THE SAME

(71) Applicant: Hyundai Motor Company, Seoul (KR)

(72) Inventors: Jong Rok Park, Seoul (KR); Dong Gyu Noh, Gyeonggi-do (KR); Cho Rong Ryu, Incheon (KR); Dae Sung Hwang, Gyeonggi-do (KR); Hahk Rel Noh, Gyeonggi-do (KR); Su Lyun Sung, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 64 days.

(21) Appl. No.: 14/938,383

(22) Filed: Nov. 11, 2015

(65) Prior Publication Data

US 2016/0140842 A1 May 19, 2016

(30) Foreign Application Priority Data

Nov. 19, 2014 (KR) ..... 10-2014-0161761

(51) Int. Cl.

| | |
|---|---|
| ***G08G 1/09*** | (2006.01) |
| ***G08G 1/01*** | (2006.01) |
| ***G08G 1/017*** | (2006.01) |
| ***G08G 1/052*** | (2006.01) |

(52) U.S. Cl.

CPC ..... *G08G 1/0112* (2013.01); *G08G 1/017* (2013.01); *G08G 1/052* (2013.01)

(58) Field of Classification Search

None

See application file for complete search history.

(56) References Cited

U.S. PATENT DOCUMENTS

| | | | | |
|---|---|---|---|---|
| 2009/0174572 | A1* | 7/2009 | Smith | G08G 1/0965 340/902 |
| 2011/0080302 | A1* | 4/2011 | Muthaiah | H04L 47/10 340/903 |
| 2011/0128902 | A1 | 6/2011 | Guo | |
| 2011/0258435 | A1* | 10/2011 | Bellur | H04L 9/3273 713/158 |
| 2013/0297195 | A1* | 11/2013 | Das | G08G 1/163 701/117 |

FOREIGN PATENT DOCUMENTS

| | | |
|---|---|---|
| JP | 2011-120232 A | 6/2011 |
| KR | 10-2010-0012578 | 2/2010 |
| KR | 10-2014-0080056 | 6/2014 |
| KR | 10-2014-0090492 | 7/2014 |

* cited by examiner

*Primary Examiner* — Brian Zimmerman
*Assistant Examiner* — Kevin Lau
(74) *Attorney, Agent, or Firm* — Mintz Levin Cohn Ferris Glovsky and Popeo, P.C.; Peter F. Corless

(57) ABSTRACT

An on-board unit of a vehicle communication system includes: a reception module receiving a message including driving information of a nearby vehicle from the nearby vehicle; and a misbehaving vehicle detection module analyzing the received message and detecting a misbehaving vehicle based on the analyzed message.

13 Claims, 7 Drawing Sheets

METHOD FOR HANDLING MISBEHAVING VEHICLE AND V2X COMMUNICATON SYSTEM PERFORMING THE SAME

CROSS-REFERENCE TO RELATED APPLICATION

This application claims the benefit of and priority to Korean Patent Application No. 10-2014-0161761, filed on Nov. 19, 2014, in the Korean Intellectual Property Office, the disclosure of which is incorporated herein in its entirety by reference.

TECHNICAL FIELD

The present disclosure relates generally to a method for handling a vehicle when a certificate thereof has been hacked in a "vehicle-to-anything" (V2X) communication system, and an on-board unit (OBU) and a server of the V2X communication system.

BACKGROUND

A V2X communication system refers to a system in which a communication terminal is mounted in a vehicle to perform vehicle-to-vehicle (V2V) communication or vehicle-to-infrastructure (V2I) communication, hence the phrase "vehicle-to-anything" communication. The V2X communication system enables a vehicle to exchange information with another vehicle or an infrastructure, typically in order to prevent traffic accidents.

The Department of Transportation (DOT) of the United States has recently declared that it will prepare a bill which mandates mounting of communication terminals enabling V2V communication and attempts to implement a V2X communication system in the United States and Europe. As part of implementation of the V2X communication system, wireless access in vehicular environment (WAVE) using a 5.8 GHz frequency band is taken into consideration. However, since WAVE is based on the assumption of communication, it is inevitably exposed to threats such as hacking. Thus, IEEE1609.2 has been established recently as an international standard to define standards for vehicles to comply with in wireless communication with an external infrastructure system, as well as other vehicles.

In the aforementioned V2X communication environment, a certificate allowing for identification of a vehicle and vehicle communication may be provided to each vehicle. However, in the V2X communication environment, the certificate of a vehicle may be subject to an error occurring by itself or may be hacked by a third party. An erroneous or hacked certificate may cause erroneous driving information or condition information to be transmitted to another vehicle or an infrastructure. In addition, such an error or hacking may affect a control device of the corresponding vehicle, seriously threatening safety driving.

SUMMARY

The present disclosure has been made to solve the above-mentioned problems occurring in the related art while advantages achieved by the related art are maintained intact.

An aspect of the present disclosure provides a method for handling a misbehaving vehicle, whereby a vehicle may detect a misbehaving vehicle and a server verifies the misbehaving vehicle and revokes a certificate of the verified misbehaving vehicle, and a vehicle communication system performing the same.

According to embodiments of the present disclosure, an on-board unit (OBU) of a vehicle communication system includes: a reception module receiving a message including driving information of a nearby vehicle from the nearby vehicle; and a misbehaving vehicle detection module analyzing the received message and detecting a misbehaving vehicle based on the analyzed message.

The driving information may include at least one of location information, speed information, and heading direction information of the nearby vehicle, and the misbehaving vehicle detection module may detect the misbehaving vehicle by analyzing at least one of the location information, the speed information, and the heading direction information of the nearby vehicle.

The misbehaving vehicle detection module of the OBU of the vehicle communication system may detect the misbehaving vehicle by comparing a reception period of the message with a predetermined communication period.

The OBU of the vehicle communication system may further include a transmission module configured to transmit a misbehavior report message including a result of the analyzed message and a vehicle identification (ID) of the detected misbehaving vehicle to a server or another vehicle.

Furthermore, according to embodiments of the present disclosure, a server of the vehicle communication system includes: a communication module receiving at least one misbehavior report message; and a misbehaving vehicle verification module analyzing the at least one received misbehavior report message to determine whether a vehicle indicated by the misbehavior report message is a misbehaving vehicle.

The server of the vehicle communication system may further include: a certificate storage module storing a certificate provided to each vehicle; and a certificate management module revoking a certificate of a verified vehicle from the certificate storage module when the vehicle indicated by the misbehavior report message is determined to be a misbehaving vehicle.

The vehicle communication system may be implemented based on wireless access vehicular environment (WAVE) communication, and follow a communication security standard based on IEEE 1609.2.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION OF THE EMBODIMENTS

The present disclosure may be modified variably and may have various embodiments, particular examples of which will be illustrated in drawings and described in detail. However, it is to be understood that the present disclosure is not limited to a specific disclosed form, but includes all modifications, equivalents, and substitutions without departing from the scope and spirit of the present disclosure. In describing embodiments of the present disclosure, a detailed description of known techniques associated with the present disclosure unnecessarily obscures the gist of the present disclosure, it is determined that the detailed description thereof will be omitted.

Terms used in the present specification are used only in order to describe specific embodiments rather than limiting the present disclosure. Singular forms are intended to include plural forms unless the context clearly indicates otherwise. As used herein, the singular forms "a", "an" and "the" are intended to include the plural forms as well, unless the context clearly indicates otherwise. It will be further understood that the terms "comprises" or "have" used in this specification, specify the presence of stated features, numerals, components, parts, or a combination thereof, but do not preclude the presence or addition of one or more other features, numerals, components, parts, or a combination thereof.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

Additionally, it is understood that one or more of the below methods, or aspects thereof, may be executed by at least one control unit. The term "control unit" may refer to a hardware device that includes a memory and a processor. The memory is configured to store program instructions, and the processor is specifically programmed to execute the program instructions to perform one or more processes which are described further below. Moreover, it is understood that the below methods may be executed by an apparatus comprising the control unit in conjunction with one or more other components, as would be appreciated by a person of ordinary skill in the art.

Figure 1:
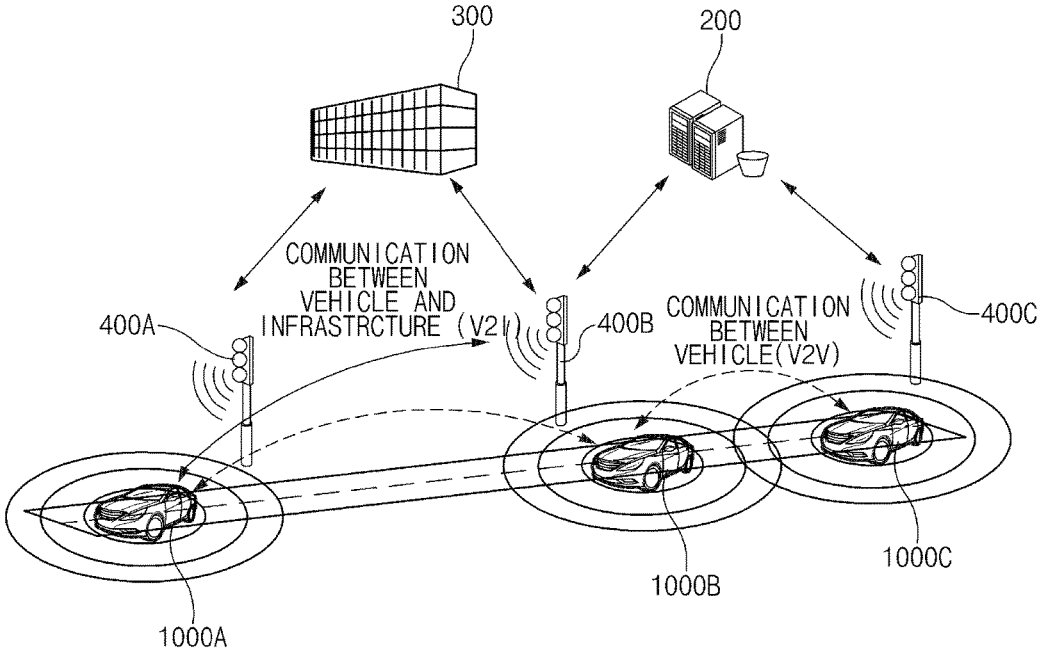
FIG. 1 is a view illustrating an environment to which a vehicle communication system and a method for handling a misbehaving vehicle according to various embodiments of the present disclosure are applied.

Referring now to the disclosed embodiments, FIG. 1 is a view illustrating an environment to which a vehicle communication system and a method for handling a misbehaving vehicle according to embodiments of the present disclosure are applied.

As shown in FIG. 1, the environment to which various embodiments of the present disclosure are applied may include vehicles 1000A to 1000C, a server 200, (a server of) a traffic information center 300, and road side units (RSUs) 400A to 400C (hereinafter, also referred to as an "RSU 400").

The vehicles 1000A to 1000C (hereinafter, also referred to as a "vehicle 1000") may have an on-board unit (OBU) 100 (please refer to FIG. 2) according to various embodiments mounted therein. For example, the vehicle 1000A may communicate with other vehicles 1000B (OBU) and 1000C through the OBU 100 (so-called V2V communication). Also, the vehicle 1000A (or the OBU 100 of the vehicle 1000A) may communicate with the server 200 or the traffic information center 300 through the RSU 400. A configuration and a function of the OBU 100 according to various embodiments included in the vehicle 1000 will be described with reference to FIGS. 2 and 3 hereinafter.

The server 200 may be an authentication server able to identify and authenticate each of the vehicles 1000A to 1000C. Also, the server 200 may communicate with the vehicle 1000 through the RSU 400 to receive a predetermined message regarding a misbehaving vehicle. The server 200 may verify the misbehaving vehicle by analyzing the predetermined message, and revoke a certificate of the vehicle verified as a misbehaving vehicle from a database of the server 200. A configuration and a function of the OBU 100 according to various embodiments included in the vehicle 1000 will be described with reference to FIG. 4 hereinafter.

The traffic information center 300 may communicate with the vehicle 1000 through the RSU 400. The traffic information center 300 may provide useful information, such as traffic information appropriate for a location and a driving condition of the vehicle 1000 or a traffic image of a driving route, to a driver.

The RSU 400 (hereinafter, also generally referred to as a "vehicle 400") may intermediate communication between the vehicle 100 and an infrastructure (e.g., the server 200 and the traffic information center 300). When communicating with the vehicle 1000 (or the OBU 100 of the vehicle 1000), the RSU 400 may support mobile communication such as WCDMA, LTE, or Wi-Fi or support wireless access in vehicular environment (WAVE) wireless communication using a frequency band of 5.8 GHz. The RSU 400 may be connected to the server 200 or the traffic information center 300 via a wired or wireless network. According to exemplary embodiments, the RSU 400 may be installed together with a signal controller or a camera for obtaining a traffic image.

In the aforementioned V2X communication environment, a certificate allowing for identifying a vehicle and vehicle communication may be given to each vehicle. The certificate may be provided in each vehicle and may be stored in a database of a server so as to be managed.

However, in the V2X communication environment, the certificate of a vehicle may be subject to an error occurring by itself or may be hacked by a third party. An erroneous or hacked certificate may cause erroneous driving information or condition information to be transmitted to another vehicle or an infrastructure. In addition, such an error or hacking may affect a control device of the corresponding vehicle, seriously threatening safety driving.

Figure 2:
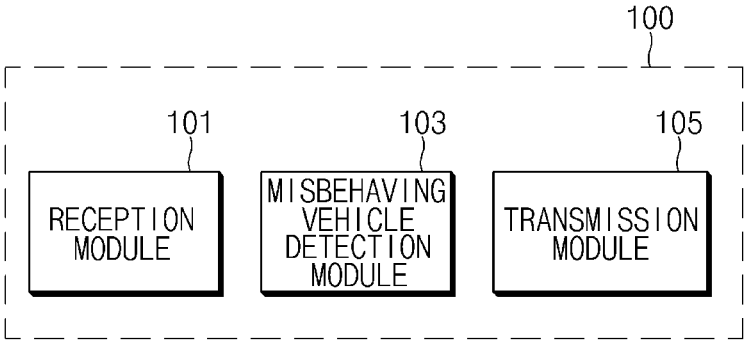
FIG. 2 is a view illustrating an on-board unit (OBU) of a vehicle communication system according to embodiments of the present disclosure.

FIG. 2 is a view illustrating the on-board unit (OBU) 100 of a vehicle communication system according to embodiments of the present disclosure.

The OBU 100 according to embodiments of the present disclosure may be mounted in each of the vehicles 1000A to 1000C. The vehicle communication system including the OBU 100 may be implemented on the basis of a WAVE communication protocol and may follow a communication security standard based on IEEE 1609.2.

The WAVE communication protocol, a combination of IEEE802.11p standard and IEEE P 1609 standard, is one of communication standards that may be utilized for establishing various next-generation intelligent traffic systems in support of high speed communication between vehicles and communication between a vehicle and an infrastructure. WAVE communication may be performed by the medium of the RSU 400 or may support direct V2V communication between vehicles. A communication module (e.g., a reception module 101, a transmission module 105, and a communication module 201) supporting WAVE communication may include a physical layer and a media access control (MAC) layer supporting communication delay of 10 msec or less at a maximum vehicle speed of 200 km/h, a communication radius of 1 km, a maximum transfer rate of 54 Mbps, a usage frequency ranging from 5.850 to 5.926 GHz, a channel band width of 10 MHz, and seven channels, and may guarantee high speed mobility, and the like.

The OBU 100 of the vehicle communication system according to embodiments of the present disclosure may include the reception module 101, a misbehaving vehicle detection module 103, and the transmission module 105. Also, although not shown in FIG. 2, the OBU 100 may additionally include an appropriate module for processing and transmitting and receiving various types of information in the V2X communication system. Also, the OBU 100 may be connected to other devices (e.g., on-board diagnostics (OBD) or an electronic control unit (ECU)) included in the corresponding vehicle to receive required information.

The reception module 101 may receive a message including driving information of a nearby vehicle from the nearby vehicle. The message may be directly received from the nearby vehicle (i.e., V2V communication) or may be indirectly received by way of the RSU 400 according to a WAVE communication protocol.

The message may include driving information of a vehicle transmitting the corresponding message and a vehicle ID. The driving information included in the message may include at least one of location information, speed information, and heading direction information of the corresponding vehicle. However, examples of the driving information are not limited thereto. For example, the driving information may include acceleration information and steering direction information of the corresponding vehicle, and may also include information obtained from the OBD and the ECU.

The misbehaving vehicle detection module 103 may analyze the message received from the nearby vehicle and detect a misbehaving vehicle which misbehaves on the basis of the analysis result. In order to detect a misbehaving vehicle, at least one of the location information, speed information, and heading direction information included in the received message may be analyzed.

FIGS. 3A, 3B, 3C, and 3D are views illustrating that the misbehaving vehicle detection module according embodiments of the present disclosure detects a misbehaving vehicle.

Figure 3A:
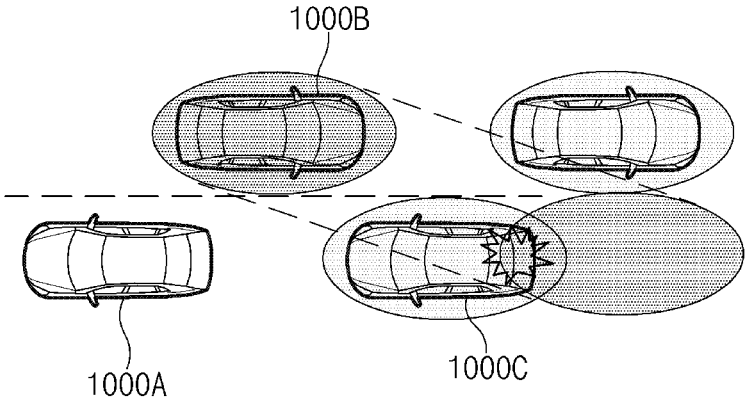
FIGS. 3A, 3B, 3C, and 3D are views illustrating that a misbehaving vehicle detection module according to embodiments of the present disclosure detects a misbehaving vehicle.

Referring to FIG. 3A, the misbehaving vehicle detection module 103 detects a misbehaving vehicle on the basis of location information. The vehicle 1000A including the OBU 100 according to embodiments may receive messages including driving information (location information) from the nearby vehicles 1000B to 1000D through WAVE communication. The misbehaving vehicle detection module 103 of the OBU 100 mounted in the vehicle 1000A may analyze location information included in the messages and recognize locations of the vehicles 1000B to 1000D which have transmitted the messages.

According to the location information of the messages received by the vehicle 1000A, a region of the vehicle 1000C is present behind the vehicle 1000A, a region of the vehicle 1000B is present in an overlapping manner behind a region of the vehicle 1000C, and a region of the vehicle 1000D is present in the opposite lane. However, the actual vehicle 1000B drives in the opposite direction in the opposite lane.

The misbehaving vehicle detection module 103 of the OBU 100 of the vehicle 1000A may recognize that the region of the vehicle 1000B overlaps behind the region of the vehicle 1000C, and detect the vehicle 1000B as a misbehaving vehicle (there is an error in a certificate thereof or hacked vehicle).

Also, according to embodiments, the misbehaving vehicle detection module 103 may detect a misbehaving vehicle using a location variation drawn from location information included in a message received at predetermined periods. As the location variation, a location variation of a driving direction (longitudinal direction), a location variation in a lateral direction, and a variation of elevation may be considered.

For example, the misbehaving vehicle detection module 103 may monitor a message received at a period of millisecond, and when a location variation of a different vehicle which has transmitted the message is significantly changed compared with a time or a speed thereof or unstable, the misbehaving vehicle detection module 103 may detect the different vehicle as a misbehaving vehicle. In particular, in a case in which locations indicated by sequentially received messages sequentially indicate locations in a direction opposite to the driving direction, the misbehaving vehicle detection module 103 may detect the vehicle which has transmitted the messages, as a misbehaving vehicle.

Figure 3B:
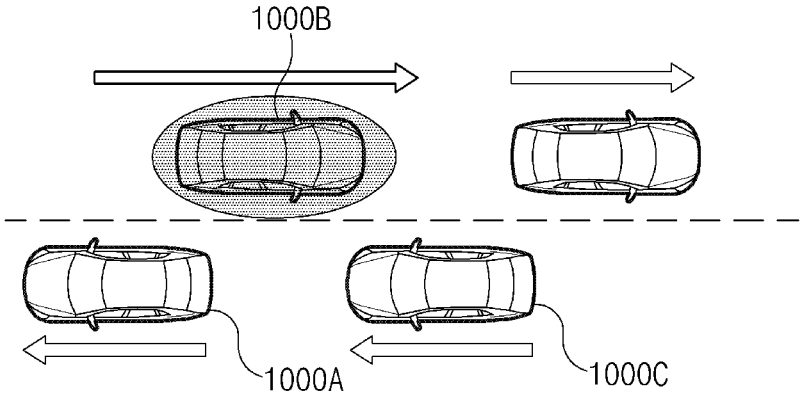

Referring to FIG. 3B, the misbehaving vehicle detection module 103 detects a misbehaving direction on the basis of speed information. The vehicle 1000A including the OBU 100 according to embodiments may receive messages including driving information (speed information) from the nearby vehicles 1000B to 1000D through WAVE communication. The misbehaving vehicle detection module 103 of the OBU 100 mounted in the vehicle 1000A may recognize speeds of the vehicles 1000B to 1000D which have transmitted the messages, by analyzing the speed information included in the messages.

The arrows shown in FIG. 3B indicate a speed (vector0). According to the speed information of the messages received by the vehicle 1000A from the vehicles 1000B to 1000D, the speeds of the vehicle 1000A and the vehicle 1000C have the same magnitude in the same direction. However, the vehicle 1000B and the vehicle 1000D in the opposite lane are in the same direction, but the speed of the vehicle 1000B is nearly double the speed of the vehicle 1000D. Thus, the misbehaving vehicle detection module 103 of the OBU 100 of the vehicle 1000A may detect the vehicle 1000B as a misbehaving vehicle. That is, the misbehaving vehicle detection module 103 may detect the vehicle 1000B at an excessively high speed, compared with vehicle positions, as a vehicle that misbehaves.

Figure 3C:
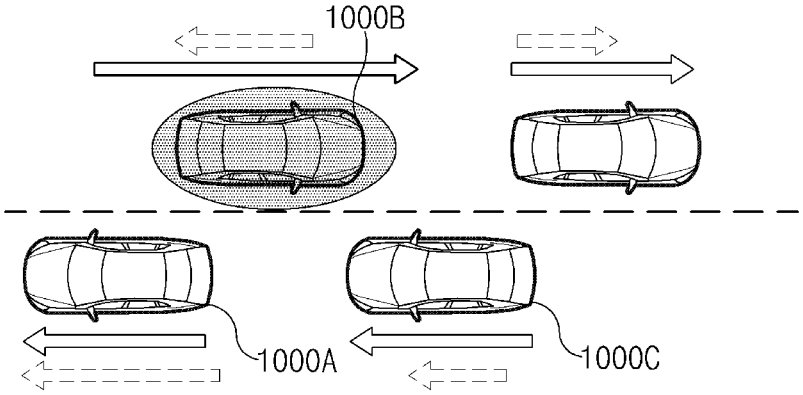
Figure 3D:
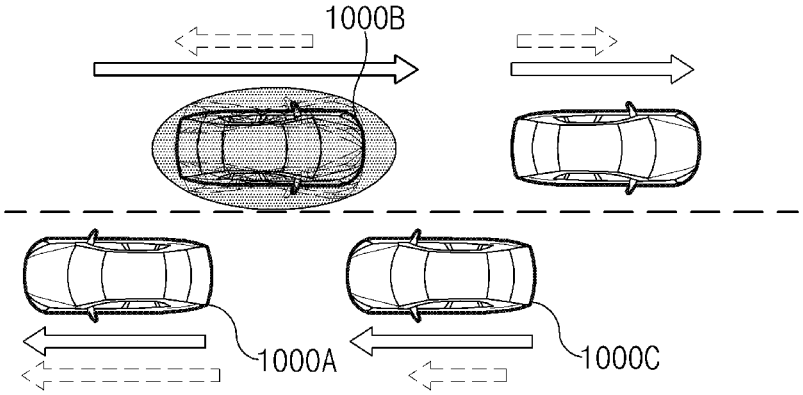

Referring to FIG. 3C, the misbehaving vehicle detection module 103 detects a misbehaving vehicle on the basis of heading information. Heading direction information of a vehicle is information regarding an objective driving direction of a vehicle, which can be obtained by a GPS module using satellites or a digital compass module using a geomagnetic sensor.

The vehicle 1000A including the OBU 100 according to an exemplary embodiment may receive messages including driving information (heading direction information) from the nearby vehicles 1000B to 1000D through WAVE communication. The misbehaving vehicle detection module 103 of the OBU 100 mounted in the vehicle 1000*a* may recognize heading directions of the vehicles 1000B to 1000*d* which have transmitted the message by analyzing the heading direction information included in the messages.

The arrows indicated by the dotted lines in FIG. 3C indicate heading directions included in previously received messages, and the arrows indicated by the solid lines indicate heading directions included in messages received later. According to the heading direction information of the messages received by the vehicle 1000A from the vehicles 1000B to 1000D, heading directions of the vehicle 1000A and the vehicle 1000C are the same as the directions of west (i.e., the leftward direction in the drawing) in the previously received message and in the message received later, and heading directions of the vehicle 1000D in the opposite lane are the same as the directions of east (i.e., the rightward direction in the drawing) in the previously received message and in the message received later. However, the direction of the vehicle 1000B in the opposite lane was in a heading direction (dotted line) as the direction of west, but later, the vehicle 1000B is in a heading direction (solid line) as the direction of east, the completely opposite direction. Thus, the misbehaving vehicle detection module 103 of the OBU 100 of the vehicle 1000A may detect the vehicle 1000B that misbehaves, as a misbehaving vehicle. That is, the message that may include driving information may be received at an interval of milliseconds, and thus, the vehicle 1000B whose heading direction was changed to the completely opposite direction may be detected as a misbehaving vehicle within a very short time.

The misbehaving vehicle detection module 103 may detect a misbehaving vehicle by comparing a reception period of a message received from the same vehicle with a predetermined communication period, as well as the driving information. For example, in a case in which a message is received at a faster or (slower) period deviating from a predetermined range in a predetermined communication period from the same vehicle, the misbehaving vehicle detection module 103 may detect the same vehicle as a misbehaving vehicle.

The methods for detecting a misbehaving vehicle from a message received from a different vehicle are not limited thereto. Also, the reference for determining a misbehaving vehicle may become more strict by combining (e.g., AND-ing) the methods for detecting a misbehaving vehicle described above. In addition, a driving pattern of the misbehaving vehicle having an erroneous or hacked certificate is made to a database through machine learning, based on which a misbehaving vehicle may be detected.

The misbehaving vehicle detection module 103 may create a misbehavior report message including a vehicle ID of the misbehaving vehicle detected through the aforementioned method, driving information of the detected misbehaving vehicle, and analysis results regarding the misbehavior.

Referring back to FIG. 2, the transmission module 105 may transmit the misbehavior report message including the analysis results and the vehicle ID detected as a misbehaving vehicle from the misbehaving vehicle detection module 103 to the server 200 or another vehicle. For example, the transmission module 105 may transmit the misbehavior report message to a nearby vehicle or may transmit the misbehavior report message to the server 200 and the traffic information center 300 by way of the RSU 400.

Figure 4A:
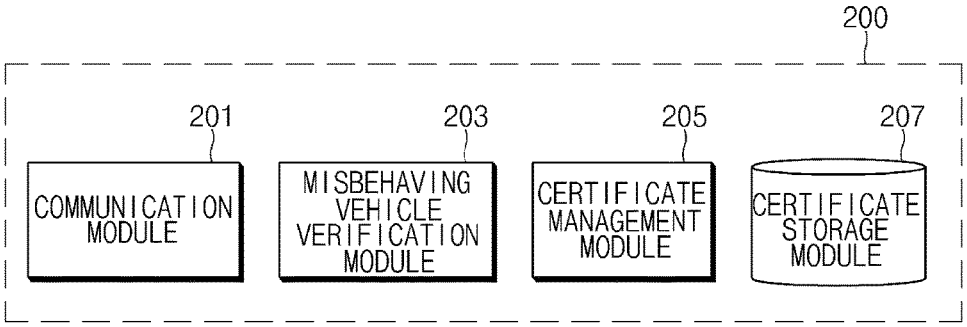
FIG. 4A is a block diagram of a server of a vehicle communication system according to embodiments of the present disclosure.
Figure 4B:
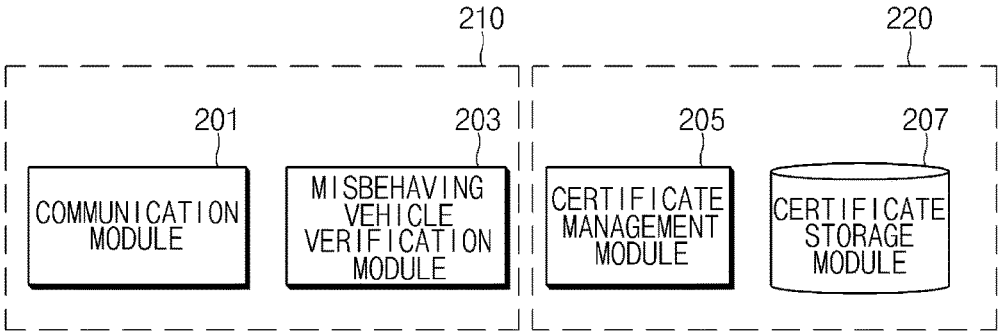
FIG. 4B is a block diagram of an alternate server of a vehicle communication system according to embodiments of the present disclosure.

FIG. 4A is a block diagram of the server of the vehicle communication system according to embodiments of the present disclosure. FIG. 4B is a block diagram of an alternate server of a vehicle communication system according to embodiments of the present disclosure.

Referring to FIG. 4A, the server 200 of the vehicle communication system according to embodiments of the present disclosure may include a communication module 201, a misbehaving vehicle verification module 203, a certificate management module 205, and a certificate storage module 207.

The communication module 201 may receive one or more misbehavior report messages from one or more vehicles. For example, in FIG. 1, the communication module 201 may receive misbehavior report messages from the plurality of vehicles 1000A to 1000C through the RSU 400 according to a WAVE communication protocol.

The misbehaving vehicle verification module 203 may verify whether a vehicle indicated by the misbehavior report message is a misbehaving vehicle by analyzing the at least one received misbehavior report message received from the communication module 201. When verifying whether the vehicle indicated by the misbehavior report message is a misbehaving vehicle, the misbehaving vehicle verification module 203 may apply more strict reference than that used for detecting a misbehaving vehicle applied to the OBU 100. The misbehaving vehicle verification module 203 may enhance reliability of verification of a misbehaving vehicle in consideration of the number of times of reception of the misbehavior report messages received from a plurality of vehicles, and may apply more precise verification method by using device resources more abundant than that of the OBU 100.

When it is verified that the vehicle indicated by the misbehavior report message from the misbehaving vehicle verification module 203 is a misbehaving vehicle, the certificate management module 205 may revoke the certificate of the verified vehicle from the certificate storage module 207.

That is, when the vehicle indicated by the misbehavior report message is verified to be a misbehaving vehicle, the certificate management module 205 may determine that the certificate of the corresponding misbehaving vehicle has been hacked, so it may revoke the certificate of the corresponding misbehaving vehicle. According to exemplary embodiments, the certificate management module 205 may perform a certificate updating function to provide a new certificate to the certificate-revoked misbehaving vehicle.

The certificate storage module 207 may be termed a central information repository, and may store certificates given to vehicles.

The server 200 may refer to collective computing devices including a plurality of computers, work stations, and repositories, without being limited to meaning of an electronic device. Also, the server 200 may be implemented as a separate electronic device according to functions thereof, and the separate electronic device may be operated by a different subject.

For example, referring to FIG. 4B, when a registration authority (RA) server 210 performing a function of handling a certificate request from the vehicle 1000 and performing a transmission function may include a communication module 201 and a misbehaving vehicle verification module 203. The RA server 210 may be a server of a registration institution such as a financial company (e.g., a bank or a stock firm) for relaying registration such as generation or issuance of a certificate of a certificate authority.

A certificate authority (CA) server 220 handling generation and issuance of a certificate may include a certificate management module 205 and a certificate storage module 207. The CA server 220 may be a server of a certificate authority (e.g., KOSCOM (CORP.), or KICA Inc.) for certificate generation, issuance, and management to issue a certificate for each vehicle.

Figure 5:
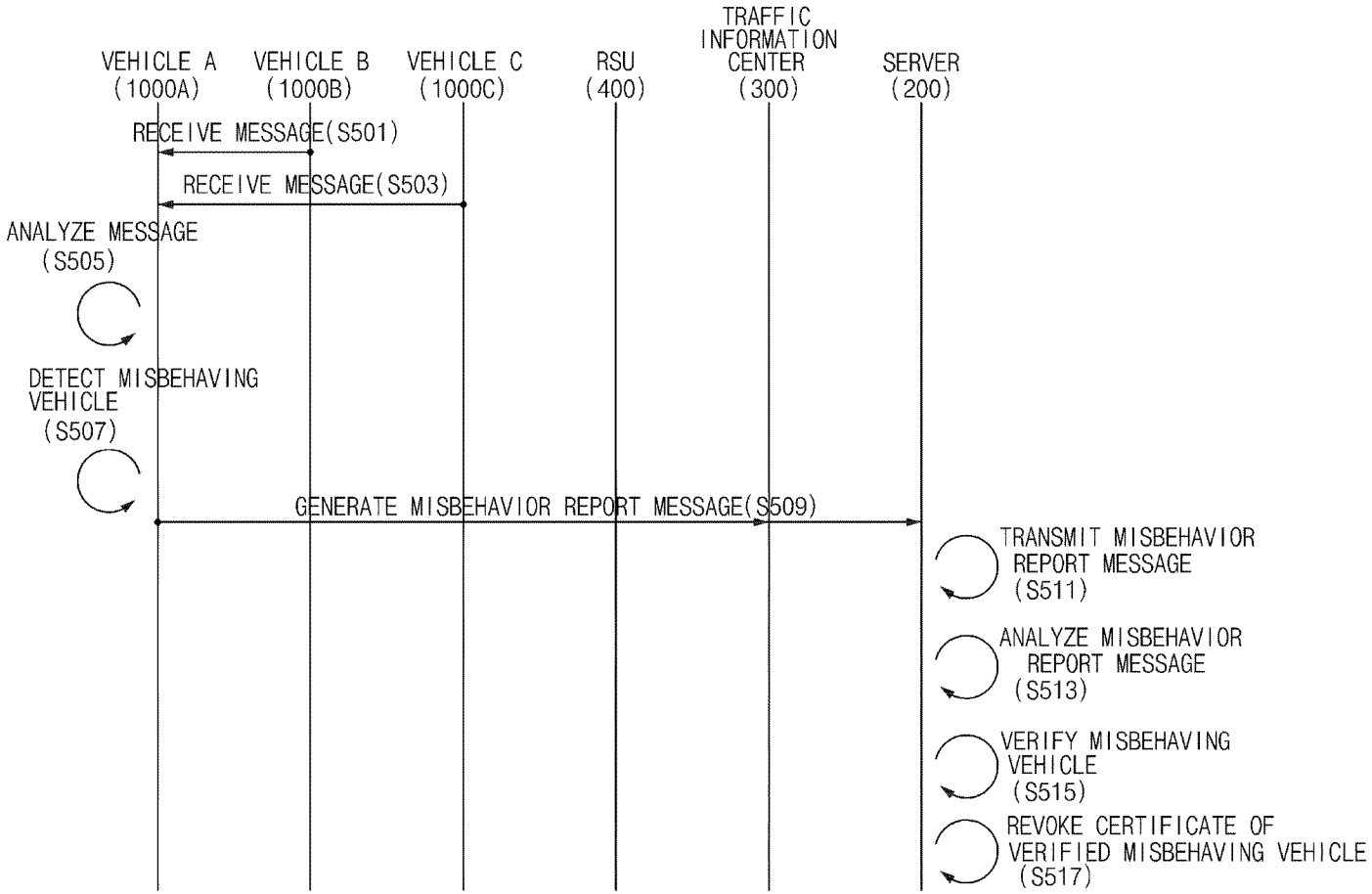
FIG. 5 is a view illustrating a method for handling a misbehaving vehicle according to embodiments of the present disclosure.

FIG. 5 is a view illustrating a method for handling a misbehaving vehicle according to embodiments of the present disclosure.

The method for handling a misbehaving vehicle in a vehicle communication system illustrated in FIG. 5 may be performed by the vehicles 1000A to 1000C having the OBU 100 of FIG. 2, the RSU 400, the traffic information center 300, and the server 200 illustrated in FIG. 4. The vehicle communication system may be implemented through WAVE communication and follow a communication security standard based on IEEE 1609.2.

In operations 5501 and 5503, the vehicle 100*b* and the vehicle 1000C adjacent to the vehicle 1000A may transmit messages including driving information thereof to the vehicle 100A (or the OBU 100 of the vehicle 1000A). The messages may be repeatedly transmitted at a predetermined time period. Also, in FIG. 5, it is illustrated that the vehicle 1000B and the vehicle 1000C transmit messages to the vehicle 1000A, but the vehicle 1000A, the vehicle 1000B, and the vehicle 1000C may transmit and receive message with respect to each other at a predetermined communication period.

In operations 5505 and 5507, the misbehaving vehicle detection module 103 of the OBU 100 of the vehicle 1000A may analyze the messages received by the reception module 101 from the vehicle 1000B and the vehicle 1000C, and detect a misbehaving vehicle on the basis of the analysis result. When analyzing the messages, the misbehaving vehicle detection module 103 may use location information, speed information, and heading direction information of the vehicles included in the messages. Also, the misbehaving vehicle detection module 103 may detect a misbehaving vehicle by comparing reception periods of the messages with a predetermined communication period.

In operation 5509, the misbehaving vehicle detection module 103 may generate a misbehavior report message including the analysis result of the misbehaving vehicle detected in operation 5507 and the vehicle ID.

In operation 5511, the transmission module 105 may transmit the misbehavior report message including the analysis result of the misbehaving vehicle and the vehicle ID of the misbehaving vehicle to the server 200 and the traffic information center 300 by way of the RSU 400.

In operations 5513 and 5515, the misbehaving vehicle verification module 203 of the server 200 may verify whether the vehicle indicated by the misbehavior report message is a misbehaving vehicle by analyzing the misbehavior report message received in operation 5511. In order to verify whether the vehicle indicated by the misbehavior report message is a misbehaving vehicle, the misbehaving vehicle verification module 203 may perform a verification process with high precision by applying a more strict reference than that used for detecting a misbehaving vehicle applied by the OBU 100.

In operation 5517, when the vehicle indicated by the misbehavior report message is verified to be a misbehaving vehicle, the certificate management module 205 of the server 200 may revoke the certificate of the misbehaving vehicle stored in the certificate storage module 207.

According to each device of the vehicle communication system and the method for handling a misbehaving vehicle according to various embodiments of the present disclosure, a misbehaving vehicle is detected by analyzing vehicle driving information obtained from V2X communication, and it is subsequently informed to the server or another vehicle. Thus, a so-called decentralized/local validation may be implemented, and a misbehaving vehicle may be detected by using information exchanged through V2V communication.

Also, according to each device of the vehicle communication system and the method for handling a misbehaving vehicle according to various embodiments of the present disclosure, a misbehavior report message, that is, an ID of a vehicle suspicious of a misbehaving vehicle and a misbehaving vehicle analysis result, is transmitted to the server, thus implementing centralized validation. In addition, since the server determines again whether the vehicle is a misbehaving vehicle secondarily, the misbehaving vehicle may be detected with high precision. In addition, since the certificate of the misbehaving vehicle verified by the server is revoked, a possibility in which a malicious code, or the like, is introduced to other vehicles or an infrastructure may be reduced, promoting safer communication.

Hereinabove, although the present disclosure has been described with reference to embodiments and the accompanying drawings, the present disclosure is not limited thereto, but may be variously modified and altered by those skilled in the art to which the present disclosure pertains without departing from the spirit and scope of the present disclosure claimed in the following claims

What is claimed is:

1. A vehicle communication system comprising:

a reception module receiving a message including driving information of a nearby vehicle from an on-board unit equipped in the nearby vehicle;

a misbehaving vehicle detection module analyzing the received message and detecting a misbehaving vehicle based on the analyzed message;

a transmission module transmitting a misbehavior report message including a result of the analyzed message and a vehicle identification (ID) of the detected misbehaving vehicle to a server; and the server receiving the misbehavior report message from the transmission module and verifying whether the detected misbehaving vehicle is a misbehaving vehicle based on the received misbehavior report message, wherein the driving information indicates a location of the nearby vehicle, and the misbehaving vehicle detection module determines the nearby vehicle is the misbehaving vehicle when the location of the nearby vehicle overlaps a detected location of another nearby vehicle.

2. The vehicle communication system according to claim 1, wherein misbehaving vehicle detection module detects the misbehaving vehicle by analyzing the location of the nearby vehicle.

3. The vehicle communication system according to claim 1, wherein the driving information includes speed information of the nearby vehicle, and the misbehaving vehicle detection module detects the misbehaving vehicle by analyzing the speed information of the nearby vehicle.

4. The vehicle communication system according to claim 1, wherein the driving information includes heading direction information of the nearby vehicle, and the misbehaving vehicle detection module detects the misbehaving vehicle by analyzing the heading direction information of the nearby vehicle.

5. The vehicle communication system according to claim 1, wherein the misbehaving vehicle detection module detects the misbehaving vehicle by comparing a reception period of the message with a predetermined communication period.

6. The vehicle communication system according to claim 1, wherein the vehicle communication system is implemented based on wireless access vehicular environment (WAVE) communication and follows a communication security standard based on IEEE 1609.2.

7. A method for handling a misbehaving vehicle of a vehicle communication system, the method comprising:

receiving, by a reception module, a message including driving information of a nearby vehicle from an on-board unit equipped in the nearby vehicle;

analyzing, by a misbehaving vehicle detection module, the received message;

detecting, by the misbehaving vehicle detection module, a misbehaving vehicle based on the analyzed message;

transmitting, by a transmission module, a misbehavior report message including a result of the analyzed message and a vehicle identification (ID) of the detected misbehaving vehicle to a server;

receiving, by the server, the misbehavior report message from the transmission module; and verifying, by the server, whether the detected misbehaving vehicle is a misbehaving vehicle based on the received misbehavior report message, wherein the driving information indicates a location of the nearby vehicle, and the misbehaving vehicle detection module determines the nearby vehicle is the misbehaving vehicle when the location of the nearby vehicle overlaps a detected location of another nearby vehicle.

8. The method according to claim 7, further comprising detecting the misbehaving vehicle by analyzing the location of the nearby vehicle included in the driving information.

9. The method according to claim 7, further comprising detecting the misbehaving vehicle by analyzing speed information of the nearby vehicle included in the driving information.

10. The method according to claim 7, further comprising detecting the misbehaving vehicle by analyzing heading direction information of the nearby vehicle included in the driving information.

11. The method according to claim 7, further comprising detecting the misbehaving vehicle by comparing a reception period of the message and a predetermined communication period.

12. The method according to claim 7, further comprising:

revoking a certificate of a verified vehicle when the vehicle indicated by the misbehavior report message is a misbehaving vehicle.

13. The method according to claim 7, wherein the vehicle communication system is implemented based on wireless access vehicular environment (WAVE) communication, and follows a communication security standard based on IEEE 1609.2.

* * * * *